US006603100B2

(12) United States Patent
Wilkins et al.

(10) Patent No.: US 6,603,100 B2
(45) Date of Patent: Aug. 5, 2003

(54) RADIANT ELECTRIC HEATER

(75) Inventors: Peter Ravenscroft Wilkins, Droitwich (GB); George Anthony Higgins, Hagley (GB)

(73) Assignee: Ceramaspeed Limited (GB)

( * ) Notice: Subject to any disclaimer, the term of this patent is extended or adjusted under 35 U.S.C. 154(b) by 6 days.

(21) Appl. No.: 10/011,170

(22) Filed: Dec. 6, 2001

(65) Prior Publication Data

US 2002/0170906 A1 Nov. 21, 2002

(30) Foreign Application Priority Data

Dec. 16, 2000 (GB) ..... 0030758

(51) Int. Cl.[7] ..... H05B 3/68
(52) U.S. Cl. ..... 219/448.19; 219/460.1
(58) Field of Search ..... 219/448.11, 448.19, 219/411.1, 460.1, 461.1, 462.1, 463.1, 464.1

(56) References Cited

U.S. PATENT DOCUMENTS

| | | | | |
|---|---|---|---|---|
| 4,350,875 A | * | 9/1982 | McWilliams | 219/448.19 |
| 4,845,340 A | * | 7/1989 | Goessler et al. | 219/448.19 |
| 5,310,993 A | * | 5/1994 | McWilliams et al. | 219/448.19 |
| 5,489,764 A | | 2/1996 | Mannuss et al. | |
| 6,483,084 B2 | * | 11/2002 | Petri et al. | 219/460.1 |

FOREIGN PATENT DOCUMENTS

| | | |
|---|---|---|
| EP | 0503685 | 9/1992 |
| EP | 0771134 | 5/1997 |
| GB | 2278263 | 11/1994 |

OTHER PUBLICATIONS

United Kingdom Search Report Jul. 3, 2001.

* cited by examiner

*Primary Examiner*—Sang Paik
(74) *Attorney, Agent, or Firm*—Ira S. Dorman

(57) ABSTRACT

A radiant electric heater (2) comprises a dish-like support (6) having a base layer (8) of thermal insulation material. At least one heating element (10) is supported relative to the base layer. A temperature-responsive device (16) has a rod-like component (18) secured at one end at a peripheral region of the dish-like support (6) and extends without support partly across the heater over the at least one heating element (10). Restraining means (30) is provided at a free end region (28) of the rod-like component (18). The restraining means (30) has a first portion (32) thereof secured in the base layer (8) of thermal insulation material and a second portion (34) thereof at least partially surrounding and spaced from the rod-like component (18) to allow limited relative movement between the rod-like component and the second portion of the restraining means (30). The restraining means (30) serves to limit displacement of the free end (28) of the rod-like component (18) away from and/or towards the base layer (8) of thermal insulation material.

38 Claims, 5 Drawing Sheets

RADIANT ELECTRIC HEATER

The present invention relates to radiant electric heaters, such as for use in cooking appliances beneath a cooking surface, such as of glass-ceramic.

BACKGROUND TO THE INVENTION

It is known to provide a radiant electric heater comprising a dish-like support, such as of metal, having therein a base layer of thermal insulation material, such as microporous thermal insulation material. At least one electric heating element is supported relative to the base layer. Such a heater is well known to be used in cooking appliances, particularly located in contact with the underside of a cooking surface which is commonly of glass-ceramic.

For safety and/or control purposes, it is well known to provide a temperature-responsive device in the heater. Such a temperature-responsive device is known to comprise a rod-like component which typically includes an outer tube of quartz, or of ceramic such as cordierite, and which extends partly across the heater and overlying the heating element. The rod-like component is known to be secured at one end at a peripheral region of the dish-like support and suitably to a switch head which is secured to the edge of the dish-like support. The rod-like component is secured such that it is incapable of articulation at its end where secured and extends in cantilevered manner, without support, partly across the heater.

This arrangement for the temperature-responsive device suffers from a disadvantage in that cooking appliances incorporating the heater are often required to pass mechanical shock load and/or vibration tests, to ensure that damage is unlikely to occur during transportation and operation of such cooking appliances.

A typical requirement is for a cooking hob to pass a drop test in which the hob, packaged for transportation, is dropped onto a solid surface from a typical height of 0.5 to 0.6 metres. During such a drop test, large inertial forces are imposed on the free end of the rod-like component of the temperature-responsive device in the heater. Such forces can cause the free end of the rod-like component to be deflected by a considerable amount. As a result, the rod-like component may fracture, or its free end may strike the underside of the overlying glass-ceramic cooking surface and may cause fracture of the glass-ceramic material of the cooking surface.

Another test carried out by appliance approval authorities simulates a heavy pan being dropped onto a glass-ceramic cooking surface having a heater located in contact with its underside. The resulting shock loading can result in severe deflection of the free end of the rod-like component of the temperature-responsive device in the heater, with undesirable consequences similar to those previously described.

OBJECT OF THE INVENTION

It is an object of the present invention to overcome or minimise this problem.

SUMMARY OF THE INVENTION

According to the present invention there is provided a radiant electric heater comprising a dish-like support having a base layer of thermal insulation material; at least one heating element supported relative to the base layer; a temperature-responsive device having a rod-like component secured at one end at a peripheral region of the dish-like support and extending without support partly across the heater over the at least one heating element; and restraining means provided at a free end region of the rod-like component, wherein the restraining means has a first portion thereof secured in the base layer of thermal insulation material and a second portion thereof at least partially surrounding and spaced from the rod-like component to allow limited relative movement between the rod-like component and the second portion of the restraining means, the restraining means serving to limit displacement of the free end of the rod-like component away from and/or towards the base layer of thermal insulation material.

The second portion of the restraining means may be adapted to underlie and/or overlie the rod-like component.

The first portion of the restraining means may comprise one or more legs secured in the base layer of thermal insulation material. A pair of legs may be provided, which may be substantially parallel to one another or arranged with at least portions thereof at an angle to one another, for example such as to effect divergence thereof, and such as where secured in the base layer of thermal insulation material. The legs may have tapered ends to facilitate securing by insertion in the base layer of thermal insulation material.

The restraining means may be of wire form and may comprise wire bent to form the pair of legs of the first portion and necked and/or looped and/or coiled to form the second portion. The wire may be multiply-coiled to form the second portion.

One of the legs may be longer than the other and may pass through an aperture in the dish-like support, such longer leg having an end region bent over behind the dish-like support. The dish-like support may be recessed to accommodate the bent-over end region.

Alternatively the restraining means may be of apertured and/or slotted sheet form, in which case the first portion may alternatively comprise a single leg of plate-like form. Such a single leg may have increased width at a lower edge thereof.

The restraining means may be of apertured and/or slotted metal or ceramic sheet form and may be provided with one or more regions of the second portion arranged at an angle to the first portion and/or with a plurality of regions of the second portion arranged at an angle to one another.

The first portion of the restraining means may be secured by pressing into, or co-moulding with, the base layer of thermal insulation material.

The base layer of thermal insulation material may comprise microporous thermal insulation material.

The first portion of the restraining means may be secured in the base layer of thermal insulation material by embedding to part-thickness or full thickness of the base layer.

The base layer of thermal insulation material may be provided of increased density where the restraining means is secured.

The dish-like support may comprise metal.

The rod-like component may comprise a ceramic material, such as cordierite.

The radiant electric heater may be provided in contact with an underside of a cooking surface, such as of glass-ceramic.

Displacement of the free end of the rod-like component, which is limited by the restraining means, may result from a dynamic mechanical shock load applied to the heater.

For a better understanding of the present invention and to show more clearly how it may be carried into effect reference will now be made, by way of example, to the accompanying drawings in which:

DESCRIPTION OF PREFERRED EMBODIMENTS

Figure 1:
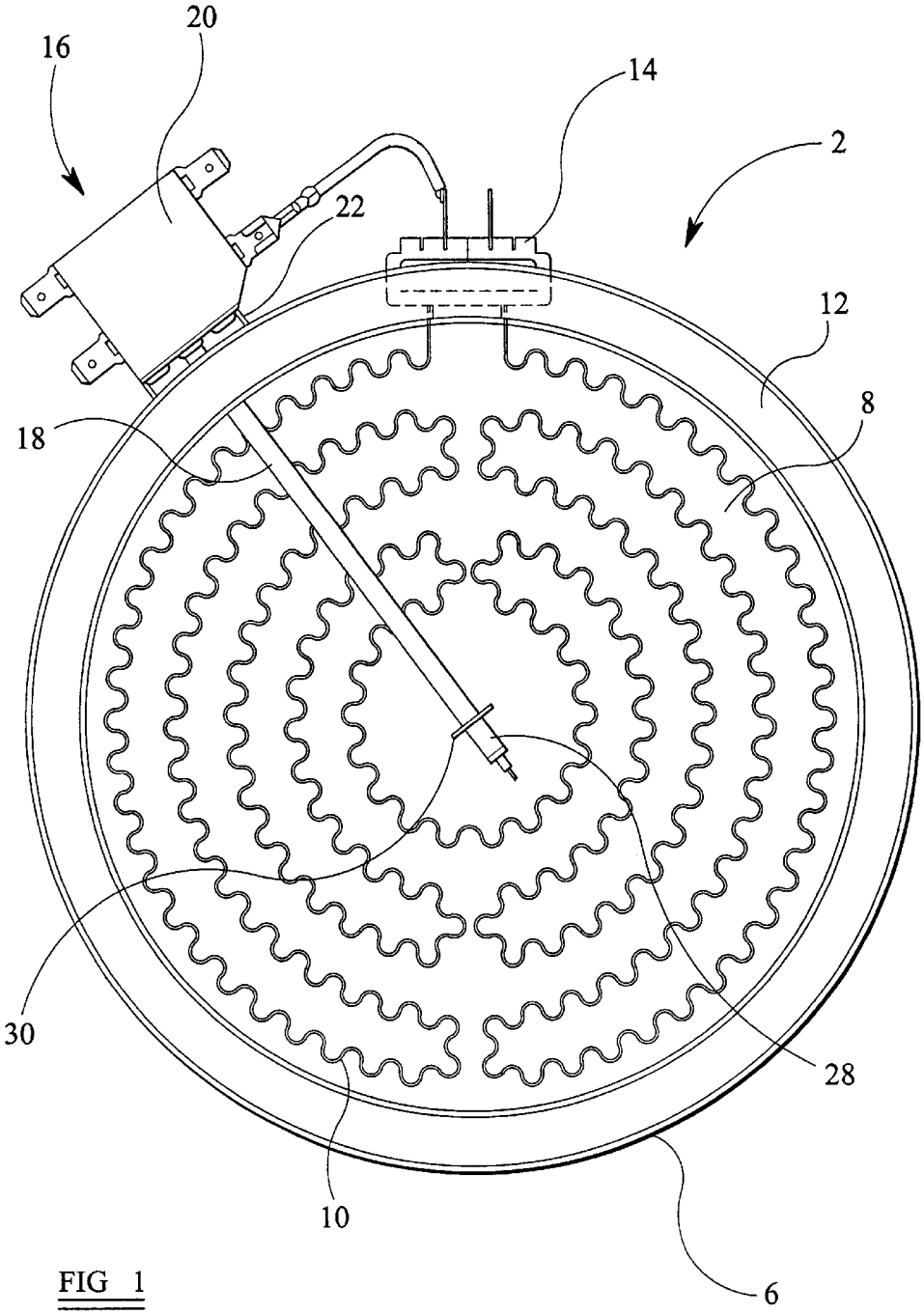
FIG. 1 is a plan view of an embodiment of a radiant electric heater according to the present invention.
Figure 2:
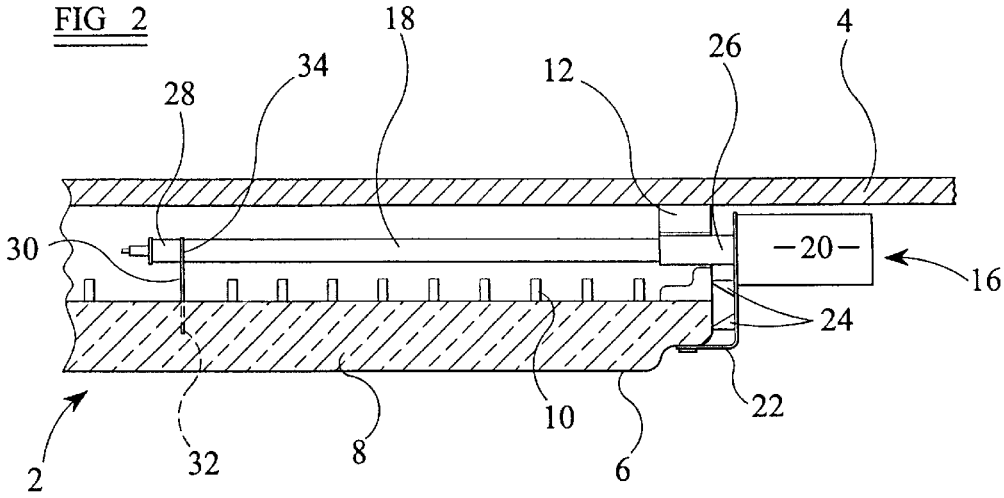
FIG. 2 is a part cross-sectional view of part of the heater of FIG. 1.

Referring to FIGS. 1 and 2, a radiant electric heater 2 is arranged for use in a cooking appliance in contact with the underside of a cooking surface 4, such as of glass-ceramic.

The heater 2 comprises a metal dish-like support 6 containing a base layer 8 of insulation material, such as microporous thermal insulation material.

At least one heating element 10 is supported relative to the base layer 8 inside the dish-like support 6. The heating element 10 can comprise any of the well known element forms. However, it may particularly comprise a corrugated metal ribbon supported edgewise on the base layer 8 and, if required, partially embedded in the base layer 8.

A peripheral wall 12 of thermal insulation material surrounds the heater and a terminal block 14 is arranged at the edge of the dish-like support 6 for electrically connecting the heating element 10 to a voltage supply for energisation.

A temperature-responsive device 16 is provided for preventing overheating of the heater. Such temperature-responsive device is of known form and comprises a rod-like component 18 secured at one end to a switch head arrangement 20. The switch head arrangement 20 is secured by a metal bracket 22 to the edge of the metal dish-like support 6. Limbs 24 extend from the bracket 22 and contact the dish-like support 6 to ensure rigidity of connection of the bracket 22 to the dish-like support.

The rod-like component 18 comprises a metal expansion rod inside a low-expansion tube, such as of quartz or a ceramic material such as cordierite. The rod-like component 18 is arranged to operate one or more switches in the switch head 20, in well known manner.

The rod-like component 18 is tightly fitted at one end inside a metal ferrule 26 which is welded to the bracket 22. The rod-like component 18 extends without support or other force acting thereon, in cantilevered manner partly across the heater and overlying the heating element 10.

A disadvantage of a temperature-responsive component 16 of such construction is that, if a cooking hob containing the heater 2 is subjected to a dynamic mechanical shock load, such as in a drop test of the hob itself or a cooking utensil dropped onto the cooking surface 4, deflection of a free end 28 of the rod-like component 18 occurs in a direction away from and/or towards the surface of the base layer 8 of thermal insulation material. A relatively small shock load of about two Newtons can result in displacement of the free end 28 of the rod-like component 18 by two or three millimetres. During test conditions, much greater shock loads and resultant displacements of the free end 28 of the rod-like component 18 occur. The free end 28 of the rod-like component 18 can oscillate or bounce away from and towards the surface of the base layer 8. If the deflection of the free end 28 is unrestrained, fracture of the outer tube of the rod-like component 18 can occur, particularly at its junction with the metal ferrule 26. Alternatively the free end 28 of the rod-like component 18 could be deflected to such an extent that it strikes the underside of the glass-ceramic cooking surface 4, causing breakage of the cooking surface 4.

This problem is overcome in the present invention by providing a restraining means 30 which permits limited displacement of the free end 28 of the rod-like component in a direction towards and/or away from the surface of the base layer 8. Such restraining means 30 has a first portion 32 secured in the base layer 8 and a second portion 34 at least partially surrounding and spaced from the rod-like component 18 at the free end 28 thereof.

Figure 3:
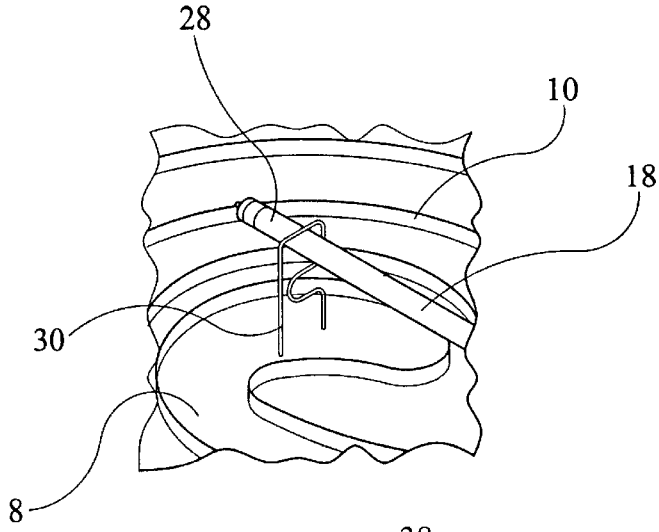
FIG. 3 is a detailed part view of part of the heater of FIG. 1.
Figure 4:
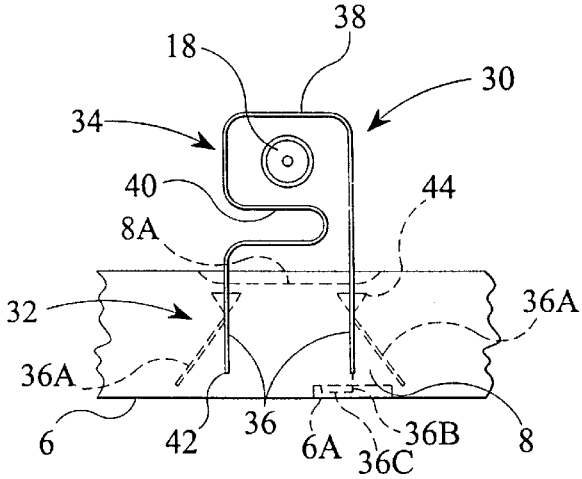
FIG. 4 is an end-on view of a rod-like component of a temperature-responsive device, and a restraining means therefor, in part of the heater of FIG. 1.
Figure 5A:
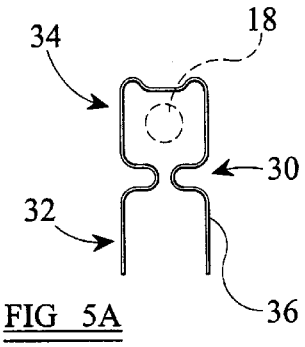
FIGS. 5, A to L, illustrates alternative forms of restraining means for use in the heater of FIG. 1.
Figure 5B:
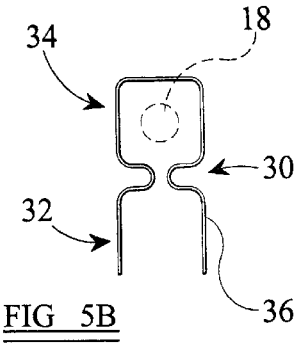
Figure 5C:
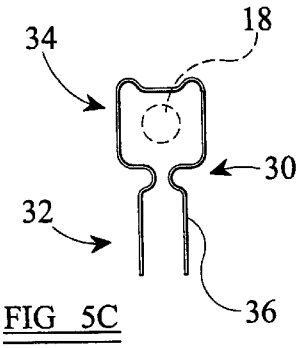
Figure 5D:
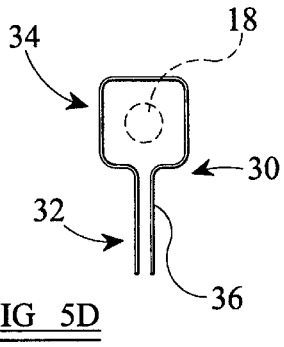
Figure 5E:
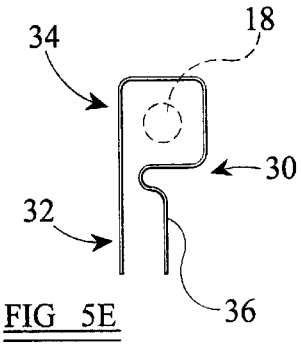
Figure 5F:
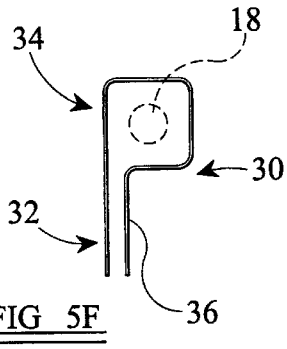
Figure 5G:
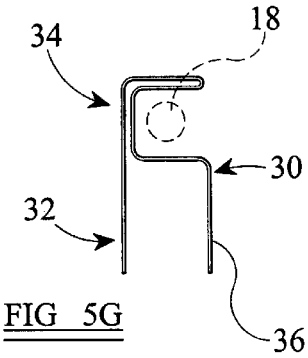
Figure 5H:
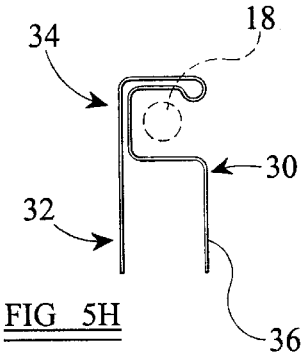
Figure 5I:
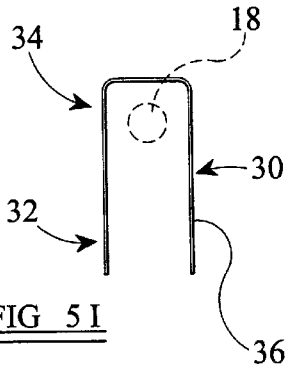
Figure 5J:
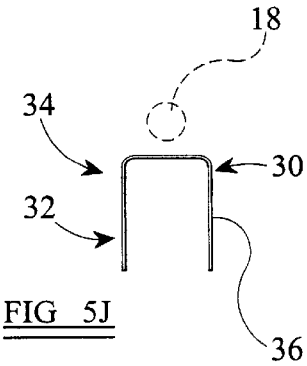
Figure 5K:
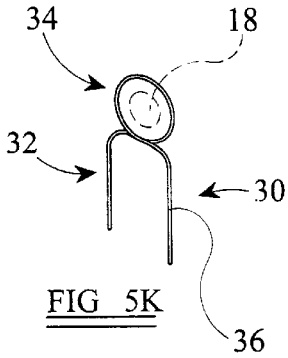
Figure 5L:
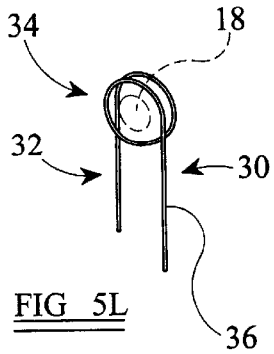
Figure 6A:
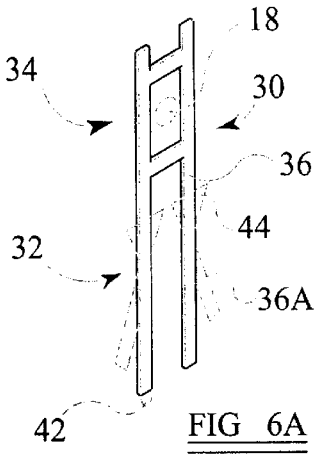
FIGS. 6, A to H, illustrates further alternative forms of restraining means for use in the heater of FIG. 1.
Figure 6B:
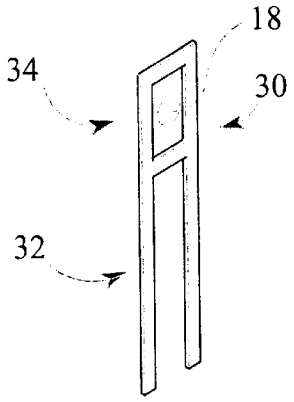
Figure 6C:
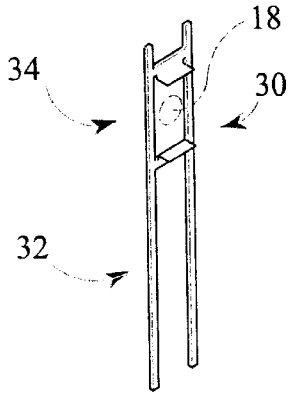
Figure 6D:
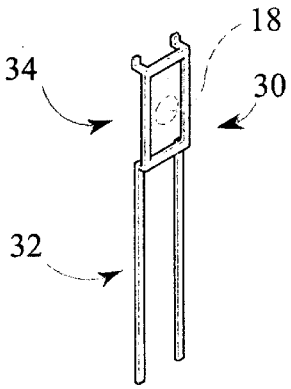
Figure 6E:
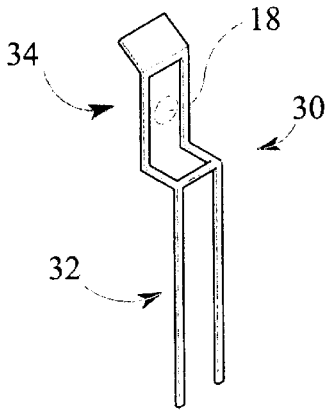
Figure 6F:
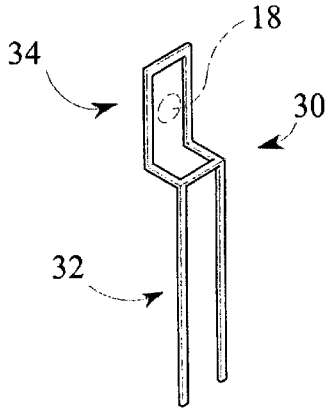
Figure 6G:
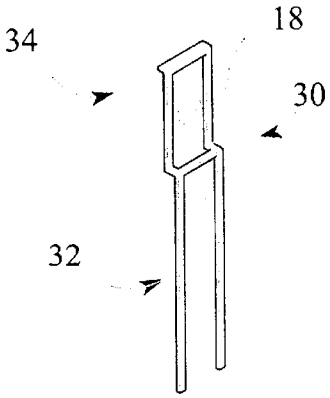
Figure 6H:
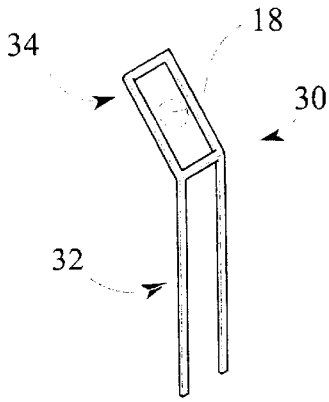

One particular embodiment of restraining means 30, used in the heater of FIGS. 1 and 2, is detailed in FIGS. 3 and 4. The restraining means 30 is formed of wire and has its first portion 32 consisting of a pair of spaced-apart wire legs 36, embedded in the base layer 8 to partial or full thickness of the base layer 8. The wire is bent and looped to form the second portion 34 of the restraining means 30 which substantially surrounds, while being spaced from, the rod-like component 18 at the free end 28 thereof. In particular, the second portion 34 of the restraining means 30 has a region 38 which overlies the rod-like component 18 and a region 40 which underlies the rod-like component 18.

Such regions 38, 40 are arranged to make contact with the rod-like component 18, when it is deflected as a result of experiencing a mechanical shock load, and limit displacement of the rod-like component 18 such that fracture thereof, or of the overlying glass-ceramic cooking surface, is prevented.

The restraining means 30 also fulfils, in some measure, a shock-absorbing role and the legs 36 may also, in some circumstances, be pulled partly out of, or pressed further into, the base layer 8, when shock load conditions are experienced.

The legs 36 may be arranged parallel to one another or may be arranged at an angle to one another, as shown by the dotted lines 36A, where embedded in the base layer 8. Such an angled arrangement increases the security of the legs in the base layer 8. The legs 36A may be arranged to diverge when pressed into the base layer 8. Alternatively, when the base layer 8 comprises compacted microporous insulation material, pre-angled legs 36A of the restraining means may be co-moulded with the insulation material during compaction of the latter. The co-moulding operation may of course be likewise carried out with a restraining means 30 having substantially parallel legs 36.

When the restraining means 30 is secured to the base layer 8 by pushing the legs 36 thereinto, the operation can be facilitated by providing the ends 42 of the legs 36 of tapered (for example pointed) form.

The legs 36 may also be provided with barbs 44 to provide enhanced securing in the base layer 8.

For increased security of the restraining means 30, one of the legs 36 could be provided of greater length than the other, as shown by reference numeral 36B, to pass through an aperture provided in the dish-like support 6. The end region of this leg is then bent over at the back of the support 6 as shown by reference numeral 36C. The dish-like support 6 can be recessed in this region as shown by reference numeral 6A.

To further enhance security of the restraining means 30, the density of the base layer 8 may be locally increased in the region where the legs 36 are embedded. This is achieved by applying local pressure to the surface of the base layer 8, which also forms a local recess 8A in the surface of the base layer 8.

As will be apparent to the skilled person, a wide variety of other wire-form shapes may be adopted for the restraining means 30. Some examples are illustrated in FIGS. 5, A to L, where wire is bent to form the pair of legs 36 of the first portion 32 and necked and/or looped and/or coiled to form the second portion 34. As shown in I of FIG. 5, the second portion 34 need not underlie the rod-like component 18 and, as shown in J of FIG. 5, the second portion 34 need not overlie the rod-like component 18.

K and L of FIG. 5 show arrangements in which the second portion 34 is formed by single and double coils of wire respectively.

Instead of providing the restraining means 30 of wire form, it could be provided of apertured and/or slotted sheet form and suitably comprising metal or ceramic. Some examples are illustrated in FIGS. 6, A to H. As with the wire-form embodiments, each comprises a first portion 32, in the form of a pair of legs 36, for securing in the base layer 8 of thermal insulation material, and a second apertured portion 34 for surrounding the rod-like component 18 while being spaced therefrom. As with the wire-form embodiments, the legs 36 could be of angled form 36A and the ends 42 of the legs 36 could be tapered.

The legs 36 could also be provided with barbs 44 to enhance security in the base layer 8.

The first and second portions 32, 34 could be substantially coplanar, as shown in A and B of FIG. 6. Alternatively, as shown in C to H of FIG. 6, the second portion 34 could be arranged at an angle to the first portion 32, or one or more regions of the second portion 34 could be arranged at an angle to the first portion 32. Regions of the second portion 34 could also be arranged at an angle to one another. The aperture in the second portion 34 could be circular, rather than rectangular as shown.

Figure 7:
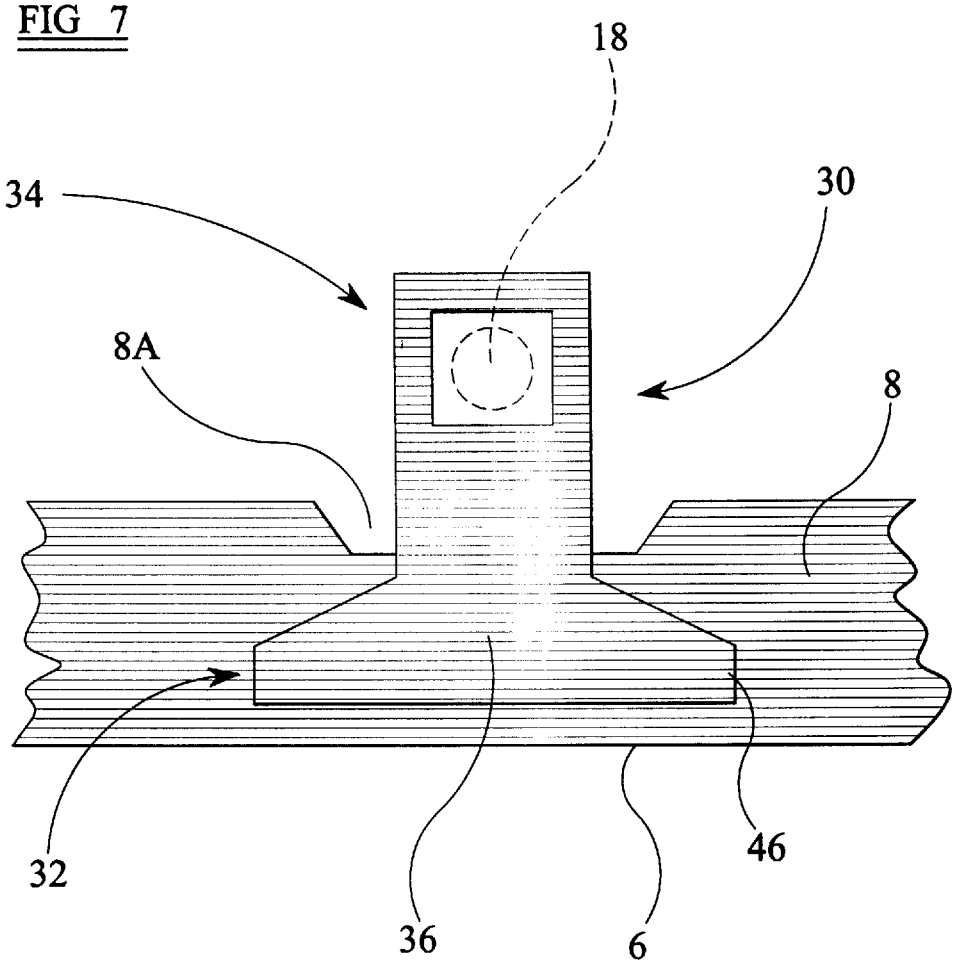
FIG. 7 illustrates a still further form of restraining means in the heater of FIG. 1.

When the restraining means is provided of apertured metal or ceramic sheet form, it may be advantageous to provided the first portion 32 as a single leg of plate-like form, as shown in FIG. 7. The single leg 36 is preferably co-moulded with the base layer 8 of microporous insulation material and is provided of increased width 46 at a lower edge thereof to enhance securing thereof in the base layer 8. The security can be further enhanced by locally increasing the compaction density of the microporous insulation material of the base layer 8 around the leg 36. This is achieved by applying pressure locally to the surface of the base layer 8 and also results in formation of a recess 8A in the surface of the base layer 8.

The second portion 34 of the restraining means is apertured and surrounds the rod-like component 18 while being spaced therefrom.

We claim:

1. A radiant electric heater comprising a dish-like support having a base layer of thermal insulation material; at least one heating element supported relative to the base layer; a temperature-responsive device having a rod-like component secured at one end at a peripheral region of the dish-like support and extending without support partly across the heater over the at least one heating element; and restraining means provided at a free end region of the rod-like component, wherein the restraining means has a first portion thereof secured in the base layer of thermal insulation material and a second portion thereof at least partially surrounding and spaced from the rod-like component to allow limited relative movement between the rod-like member and the second portion of the restraining means, the restraining means serving to limit displacement of the free end of the rod-like component away from and/or towards the base layer of thermal insulation material.

2. A heater as claimed in claim 1, wherein the second portion of the restraining means is adapted to underlie the rod-like component.

3. A heater as claimed in claim 1, wherein the second portion of the restraining means is adapted to overlie the rod-like component.

4. A heater as claimed in claim 1, wherein the first portion of the restraining means comprises at least one leg secured in the base layer of thermal insulation material.

5. A heater as claimed in claim 4, wherein a pair of legs is provided.

6. A heater as claimed in claim 5, wherein the legs are substantially parallel to one another.

7. A heater as claimed in claim 5, wherein the legs are arranged with at least portions thereof at an angle to one another.

8. A heater as claimed in claim 7, wherein the legs are arranged with at least portions thereof at an angle to one another to effect divergence thereof.

9. A heater as claimed in claim 7, wherein the legs are arranged with at least portions thereof at an angle to one another where secured in the base layer of thermal insulation material.

10. A heater as claimed in claim 5, wherein the legs have tapered ends to facilitate securing by insertion in the base layer of thermal insulation material.

11. A heater as claimed in claim 1, wherein the restraining means is of wire form.

12. A heater as claimed in claim 11, wherein the restraining means comprises wire bent to form the pair of legs of the first portion and necked to form the second portion.

13. A heater as claimed in claim 11, wherein the restraining means comprises wire bent to form the pair of legs of the first portion and looped to form the second portion.

14. A heater as claimed in claim 11, wherein the restraining means comprises wire bent to form the pair of legs of the first portion and coiled to form the second portion.

15. A heater as claimed in claim 14, wherein the wire is multiply-coiled to form the second portion.

16. A heater as claimed in claim 5, wherein one of the legs is longer than the other and passes through an aperture in the dish-like support, such longer leg having an end region bent over behind the dish-like support.

17. A heater as claimed in claim 16, wherein the dish-like support is recessed to accommodate the bent over end region.

18. A heater as claimed in claim 1, wherein the restraining means is of apertured sheet form.

19. A heater as claimed in claim 18, wherein the first portion comprises a single leg of plate-like form.

20. A heater as claimed in claim 19, wherein the single leg has increased width at a lower edge thereof.

21. A heater as claimed in claim 18, wherein the restraining means is selected from metal and ceramic sheet form.

22. A heater as claimed in claim 18, wherein the restraining means is provided with at least one region of the second portion arranged at an angle to the first portion.

23. A heater as claimed in claim 18, wherein the restraining means is provided with a plurality of regions of the second portion arranged at an angle to one another.

24. A heater as claimed in claim 1, wherein the restraining means is of slotted sheet form.

25. A heater as claimed in claim 24, wherein the first portion comprises a single leg of plate-like form.

26. A heater as claimed in claim 25, wherein the single leg has increased width at a lower edge thereof.

27. A heater as claimed in claim 24, wherein the restraining means is selected from metal and ceramic sheet form.

28. A heater as claimed in claim 24, wherein the restraining means is provided with at least one region of the second portion arranged at an angle to the first portion.

29. A heater as claimed in claim 24, wherein the restraining means is provided with a plurality of regions of the second portion arranged at an angle to one another.

30. A heater as claimed in claim 1, wherein the first portion of the restraining means is secured by pressing into the base layer of thermal insulation material.

31. A heater as claimed in claim 1, wherein the first portion of the restraining means is secured by co-moulding with the base layer of thermal insulation material.

32. A heater as claimed in claim 1, wherein the base layer of thermal insulation material comprises microporous thermal insulation material.

33. A heater as claimed in claim 1, wherein the first portion of the restraining means is secured in the base layer of thermal insulation material by embedding to full-thickness of the base layer.

34. A heater as claimed in claim 1, wherein the first portion of the restraining means is secured in the base layer of thermal insulation material by embedding to part-thickness of the base layer.

35. A heater as claimed in claim 1, wherein the base layer of thermal insulation material is provided of increased density where the restraining means is secured.

36. A heater as claimed in claim 1, wherein the dish-like support comprises metal.

37. A heater as claimed in claim 1, wherein the rod-like component comprises a ceramic material.

38. A heater as claimed in claim 37, wherein the ceramic material comprises cordierite.

* * * * *